United States Patent [19]

Garman et al.

[11] 4,335,624

[45] Jun. 22, 1982

[54] GOVERNOR AND DECELERATOR CONTROL LINKAGE

[75] Inventors: Ronald H. Garman, Pekin; Gerald H. Welker, Eureka, both of Ill.

[73] Assignee: Caterpillar Tractor Co., Peoria, Ill.

[21] Appl. No.: 22,747

[22] Filed: Mar. 22, 1979

Related U.S. Application Data

[63] Continuation of Ser. No. 731,472, Oct. 12, 1976, abandoned.

[51] Int. Cl.[3] ..... G05G 1/14; G05G 11/00

[52] U.S. Cl. ..... 74/482; 74/470

[58] Field of Search ..... 74/470, 481, 482

[56] References Cited

U.S. PATENT DOCUMENTS 2,433,217 12/1947 Heisel ..... 192/8
2,821,091 1/1958 Benner ..... 74/482
4,052,910 10/1977 Olt, Jr. et al. ..... 74/482
4,059,025 11/1977 Waack et al. ..... 74/482

*Primary Examiner*—Allan D. Herrmann
*Attorney, Agent, or Firm*—Hugh D. Finley

[57] ABSTRACT

A governor control linkage having a first manually operated actuator and a second manually operated actuator provides for setting of an engine governor control arm at a particular operating position by means of the first manually operated actuator, a coupling and an extensible link interconnected with the governor control arm. The coupling operatively locks the first manually operated actuator relative the setting of the governor control arm while allowing the second actuator to temporarily reposition the governor control arm at an intermediate setting. The extensible link in the first manually operated actuator returns the governor control arm and the second manually controlled actuator to the prepositioned setting upon release of the second actuator.

9 Claims, 3 Drawing Figures

10
HI
LOW
OFF
26
13
12
28
29
27
22
HI
33
LO
34
HI
OFF
24
31
62
LOW
30
OFF
68
70
66
20
18
44
74
72
64
75
37
39
38
HI
16
LOW
OFF
36
40
54
51
49
50
45
46
47
48
52
56
57
42

GOVERNOR AND DECELERATOR CONTROL LINKAGE

This is a continuation of Ser. No. 731,472, filed Oct. 12, 1976, now abandoned.

BACKGROUND OF THE INVENTION

This invention relates to a manually operated control mechanism and is particularly directed toward a device in which a first actuator may be used to position a control arm at a desired setting while a second actuator may temporarily reposition the control arm at a different setting without disturbing the setting achieved by the first actuator. Upon release of the second actuator the control arm is returned to the setting attained by the first actuator.

The invention is particularly applicable to various devices where a manually actuated lever is employed to adjust a mechanical linkage or the like at a predetermined position while retaining the capability to reposition the mechanical linkage temporarily. It is especially applicable to engine governors and it is shown and described herein as so used for purposes of illustration.

It is conventional practice to employ a governor to maintain a constant engine speed under varying load conditions particularly in heavy earth-moving equipment, where generally a compression type ignition engine is used. Various types of governors used in such applications are generally well-known in the art. A governor represented of the type herein considered is found in U.S. Pat. No. 2,961,229, assigned to the assignee of this invention. Generally, governors of the type herein described utilize a spring loaded device in a control lever to tension the governor spring. Particular tensioning of the governor spring determines the operating setting of the engine. In operation of heavy earthworking equipment it is desirable to position the governor setting at a particular engine speed to produce a particular operating speed over the ground while retaining the capability to slow the engine for brief periods without disturbing the operating speed setting of the governor.

Various schemes have been utilized to accomplish such a constant setting, but in most cases the schemes have proven complicated and in some cases cumbersome. In the operation of heavy construction equipment it is extremely desirable to provide an operating scheme for the vehicle which allows the operator to devote his attention to the job at hand. Thus, simplicity of controls is of great importance. Use of the more complex governor control systems presently available may require diversion of operator attention from the task at hand. Use of hand controls to achieve governor control is appropriate in certain systems, however in other systems wherein hand control levers control an associated implement it would be appropriate to utilize a pedal or foot operated lever to decelerate the engine from the governor controlled operating setting. Previously designed governor and decelerator control linkages which utilize a dual lever arm arrangement including an extensible link interconnecting the hand operated control lever for setting the governor have suffered from the disability that the hand control lever can be positioned beyond the normal high idle setting of the governor. Although this positioning of the control lever does not affect the governor setting, per se, as the motion is lost in the extensible link; it does affect engine operation when the operator wishes to briefly decelerate the engine utilizing the second decelerator lever as the extensible link prevents the engine from reaching its lowest idle setting. Therefore, it would be appropriate to provide a governor and decelerator control linkage which prevents the aforedescribed false high idle position while accomplishing the advantages of a simple design requiring the least amount of operator attention.

SUMMARY OF THE INVENTION

This invention provides a simply operated and easily constructed governor control linkage which permits an operator to manually selecte a desired engine operating speed with a first actuator and retain this desired operating speed under varying operating conditions. A second foot operated actuator is provided the operator to decelerate the engine from the preset operating speed for brief periods of time without disturbing the aforedescribed setting. Upon release of the second actuator, the engine speed returns to the preset setting where it will continue to operate until the first actuator is repositioned, or until the second actuator is again used to temporarily vary engine speed. The second actuator may be positioned without disturbing the first actuator because of an extensible link in the first actuator means. The first actuator means is provided with stop means to prevent extension of the extensible link resulting in the aforedescribed false high idle setting.

It is an object of this invention to provide a control linkage having a manual actuator which allows an indefinitely variable setting of a governor control device.

It is a further object of this invention to provide a second actuator in the aforedescribed linkage which allows temporary repositioning of the governor linkage in any intermediate position without disturbing the setting of the first actuator.

It is still a further object of this invention to provide the aforedescribed linkage wherein the travel of the first actuator means is limited by a stop means.

It is a further object of this invention to provide a linkage which accomplishes the aforedescribed objects in a simply operated arrangement requiring minimum operator attention.

Broadly stated, the invention is a linkage assembly for operating a speed control device such as an engine governor which has a range of operating settings including a relatively low operating speed setting and a relatively high operating speed setting. The linkage comprises a first actuator means associated with the speed control device and operably positionable for positioning the speed control device at a first operating setting greater than the relatively low operating setting. The assembly further comprises a second actuator means associated with the speed control device releasably operable for repositioning the control device from the first operating setting to a relatively lower operating speed setting. The first actuator means includes extensible link means and stop means establishing a maximum operable position for the first actuator means while allowing the second actuator means to reposition the control device at the relatively low operating speed.

These and other objects of the invention will become apparent from a study of the accompanying drawings and the following specification.

DETAILED DESCRIPTION

Figure 1:
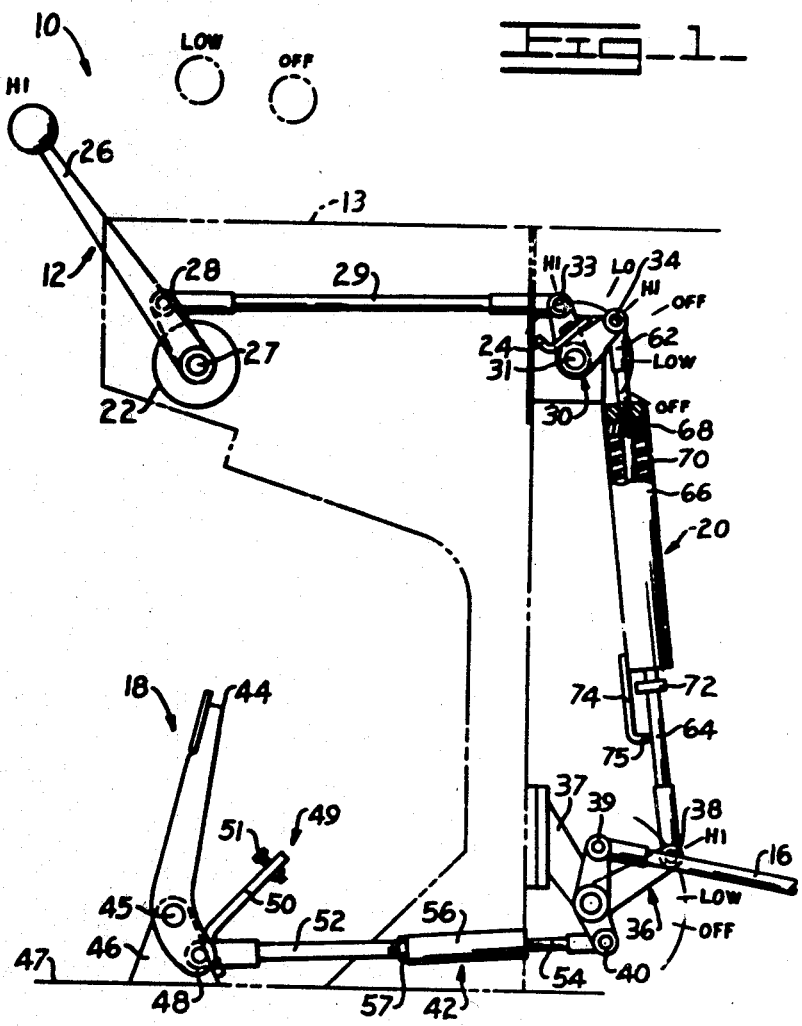
FIG. 1 is an elevation view of the linkage forming this invention.

Shown in FIG. 1 is a console mounted control linkage which is adaptable for use in an engine driven vehicle (not shown) controlled by a speed control device such as an engine governor or the like. The control linkage assembly 10 is particularly adaptable for use in setting an engine governor to operate a vehicle engine at a predetermined speed while allowing the operator to temporarily decelerate the engine without influencing the operational setting of the governor. A hand operated first actuator means 12 mounted in an operator's console 13 (in phantom lines in FIG. 1) permits an operator to position a governor control arm link 16 at a particular operating setting. Control arm link 16 is envisioned as operating a governor (not shown) of the type described in U.S. Pat. No. 2,961,229 assigned to the assignee of this invention. Due to the nature of heavy equipment operation, it is advantageous to provide a means to temporarily decelerate an engine from an operational setting for various reasons such as operating an associated implement. Accordingly, a second actuator means 18 is provided in this invention to allow the operator to reposition control arm link 16 so that an associated engine governor is returned to the low speed or low idle position without disturbing the positioning of the first actuator means 12.

In order to achieve this capability of temporarily repositioning control arm link 16 a lost motion link such as extensible link 20 must be incorporated into the first actuator means. In addition to extensible link 20, a coupling means such as one way coupling 22 must be incorporated into the first actuator means to allow positioning of the first actuator means by the operator without allowing this position to be influenced by engine vibration or in this instance the temporary repositioning of control arm link 16 by the second actuator means 18. One way couplings such as one way coupling 22 are well known in the art and will not be further described at this point; however, as the detailed description of the present invention is disclosed herein the operation of one way coupling 22 will become more apparent. Such a one-way coupling is disclosed in the U.S. Pat. No. 2,433,217 issued to A. G. Heisel on Dec. 23, 1947. To include the extensible link 20 and one way coupling 22 by itself in this invention results in a serious drawback which is overcome by a stop member 24. Stop member 24 prevents an operator from rotating a hand control lever in a counterclockwise direction past a high idle setting of the linkage as seen in FIG. 1. Although the construction of the governor envisioned for use herein (not shown) will not be positioned past the high idle setting due to the extensible link 20, to so position the control lever past the high idle setting may preclude temporary resetting of the governor to a low idle setting. It will become apparent that without stop member 24, the operator could position a hand control lever such that a high idle setting is falsely indicated and second actuator means 18 will not fully decelerate the engine.

Reference is now made to FIG. 1 for a more detailed description of the first and second actuator means. First actuator means 12 is comprised of a lever arm 26 extending radially from a shaft 27 mounted in console 13. Lever arm 26 is radially positionable in a counterclockwise direction in a range of positions extending from the phantom indicated "off" position through a "low" position to the "high" position shown in FIG. 1. A second lever arm 28 is coupled to shaft 27 by coupling 22 so that lever arm 28 is positionable only by repositioning lever arm 26. That is, coupling 22 acts as a one way coupling preventing positioning of lever arm 26 by repositioning lever arm 28. An elongated link 29 couples lever arm 28 to a bell crank 30 mounted on a shaft 31 which in turn is mounted in console 13. Bell crank 30 is rotatable on shaft 31 responsive to movement of lever arm 26 through coupling 22, lever arm 28 and link 29 acting on the first arm 33 of bell crank 30. Second arm 34 of bell crank 30 is angularly displaced from first arm 33 and is operatively connected with an extensible link 20. Extensible link 20 is interconnected at the other opposite end to a second bell crank 36 rotatably mounted on a bracket means 37 which is affixed to console 13. Second bell crank 36 is formed with three arms, the first arm 38 of second bell crank 36 being operatively connected to extensible link 20. Second arm 39 of bell crank 36 is operatively connected with control arm link 16 which may be interconnected with the aforementioned speed control device or engine governor. Third arm 40 of second bell crank 36 is connected to a compressible link 42 which forms a portion of second actuator means 18.

Figure 3:
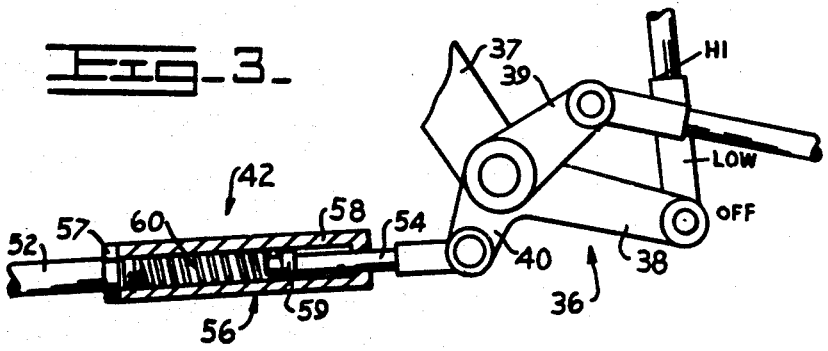
FIG. 3 is a detailed view of the compressible link in the second actuator means.

Second actuator means 18, which in the embodiment described herein is operable by an operator's foot through a pedal arm 44, is rotatably mounted on a shaft 45 affixed on a bracket 46 which is mounted on frame 47 and has integrally formed with it and extending radially outwardly from shaft 45 in a direction opposite that of pedal arm 44 an operating arm 48 connected to compressible link 42 to associate second actuator means 18 with the governor control arm link 16. Bracket 46 is fitted with an adjustable stop means 49 in the form of a rigid arm 50 affixed to bracket 46 extending outwardly therefrom and carrying at the extreme end an adjustable stop 51 such as a threaded bolt-nut arrangement depicted in FIG. 1. Adjustable stop 51 prevents clockwise rotation of pedal arm 44, as shown in FIG. 1, past a predetermined position so that pedal arm 44, which is used as a decelerator lever, cannot stop the associated engine. On the other hand, first actuator means 12 which is the primary governor setting control, must have the capability of rotating second bell crank 36 through a full range of operating positions from "off" to "high" corresponding to engine operating speeds. Accordingly, compressible link 42 which is shown in detail in FIG. 3 allows second bell crank 36 to be rotated by the first actuator means through a greater radius than that allowed by the second actuator means.

Compressible link 42 is comprised of an elongated first member 52, an elongated second member 54 and a compressible member 56. First member 52 is affixed at one end to operating arm 48 and is threadably adapted to be fixedly received by compressible member 56 at the other opposite end. A locking device such as lock nut 57 may be threadably received on first member 52 to lockably engage first member 52 with compressible member 56. Compressible member 56 is formed of a cylinder 58 in which second member 54 serves as a piston and piston rod. Second member 54 which is affixed at one end to third arm 40 has formed at the other end interior of cylinder 58 an enlarged portion 59 which serves as a stop for resilient spring 60 carried between enlarged portion 59 and the threadably received first member 52 interior of cylinder 58. Resilient spring 60 urges second member 54 outwardly of cylinder 58 while allowing the compressible link 42 to be compressed by a clockwise rotation of bell crank 36 to the "off" position shown in FIG. 3. Compression of the link occurs when pedal arm 44 engages stop means 49 through clockwise rotation of bell crank 36 which is rotated further to the "off" position by first actuator means 12 resulting in second member 54 moving inwardly of compressible member 56.

Extensible link 20 is comprised of a first elongated member 62 affixed at one end to second arm 34 of bell crank 30 and a second elongated member 64 affixed at one end to first arm 38 of a second bell crank 36. Interconnecting the first elongated member 62 and second elongated member 64 is a cylinder 66 in the form of a spring can rigidly affixed at one end to first elongated member 62 distal of second arm 34. Second elongated member 64 is formed with an enlarged portion 68 at the end distal from first arm 38. Enlarged portion 68 which may be threadably engaged on the end of second elongated member 64 or integrally formed therewith serves as an abutment for a resilient member 70 disposed in cylinder can 66. Resilient member 70 may be in the form of a helical spring disposed about second member 64 interior of cylinder 66 and at the end of cylinder 66 proximate arm 38 to urge second elongated member 64 inwardly of the cylinder toward first elongated member 62. The resilient member 70 allows a degree of extension of the extensible lock 20 against the urging of resilient member 70. Affixed to second elongated member 64 exterior to cylinder 66 and at a predetermined location is a second enlarged portion 72. Rigidly affixed to cylinder 66 and extending in a direction toward first arm 38 is a stop member 74 in the form of an L-shaped bracket. The enlarged portion 72 affixed to second elongated member 64 is located between cylinder 66 and the leg 75 of stop member 74. Leg 75 is curved inwardly toward second elongated member 64, as shown in FIG. 1 to cooperate with enlarged portion 72 and act as a stop in the extension of extensible link 20. Enlarged portion 72 and stop member 74 acting in cooperation allow only a predetermined amount of extension of the link. This predetermined amount of extension of link 20 is greater than the circumferential travel of first arm 38 resulting from actuation of second actuator 18. The stop member and enlarged portion may serve a second purpose to override a detent spring in an attached control device such as a governor. Specifically, use with the governor set forth in U.S. Pat. No. 2,961,229, the force required to overcome the stopped or "off" condition in the governor may be greater than the resiliency of resilient member 70, thus extensible link 20 would be extended by counterclockwise rotation of lever 26 about shaft 7 in the movement from the OFF position to the LOW position. Just prior to reaching the LOW position, enlarged portion 72 contacts stop member 74 thus urging second bell crank 36 in the upward direction, as seen in FIG. 1 through the positive force of the now fully exended extensible link 20. This positive force is transmitted through the bell crank to control arm 16 and is sufficient to overcome a detent in a governor.

Figure 2:
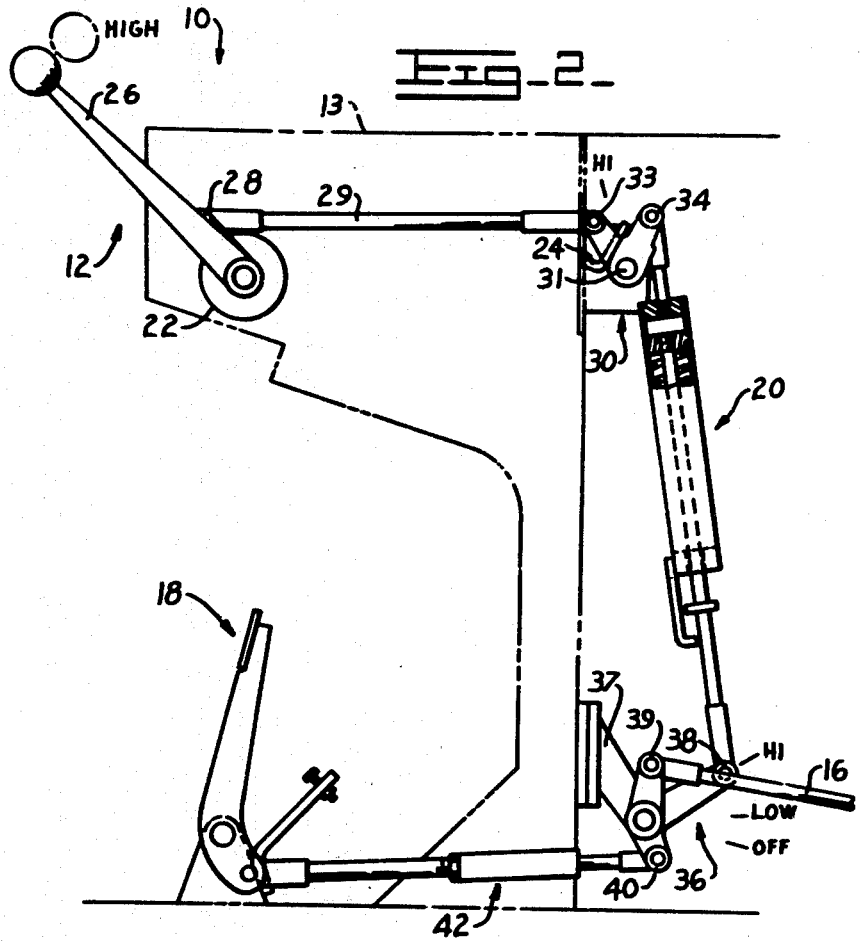
FIG. 2 is an elevation view of the linkage depicted in FIG. 1 with the stop means shown in phantom to show a false high idle setting.

Having generally described the structure of the governor and decelerator control linkage, a brief explanation of the operation will be undertaken. The governor control linkage provides for two positive settings and a range of positions from one of the positive settings to a third setting. Specifically, as seen in FIG. 1, the linkage is operable by first actuator means 12 between an OFF and a LOW setting wherein no intermediate positioning is contemplated, although the mechinism controlled by control arm link 16 could utilize intermediate positions between the OFF and the LOW position, as shown in FIG. 1. The first actuator means 12 is positionable in a range of settings between the LOW and HIGH position as indicated in FIG. 1 wherein the operator may control a speed control device such as a governor (not shown) through control arm link 16. As noted above, coupling 22 prevents the controlled device or the linkage between link 16 and shaft 27 from influencing the setting at lever 26 which has been positioned by the operator. Stop member 24 is provided in the linkage to prevent rotating lever arm 26 beyond the HIGH position. As illustrated in FIG. 2, the stop member 24 is shown in a phantom relationship with lever arm 26 rotated beyond the HIGH position, thus exending extensible link 20. Actuation of the second actuator means 18 to temporarily reposition the controlled device such as an engine governor envisioned here would not provide sufficient extension in extensible link 20 to fully reposition the control device to the LOW position shown in FIG. 2 because enlarged portion 72 contacts stop member 74 so that one way coupling 22 prevents further movement of the first actuator menas. As previously noted, with the first actuator means positioned in the HIGH position or any intermediate position between the LOW and HIGH position, the second actuator means 18 provides the operator a means to reposition the control device to a lower setting, however the stop member 49 is provided to prevent the second actuator means from returning the control device to the OFF position.

Although this linkage assembly has been described with particular reference to an engine governor it is to be understood that the linkage may be used with other devices which need positive control and a capability to temporarily return the control device to a first or original setting. Finally, it is to be understood that various modifications may be made on the linkage as described herein without departing from the scope and content of the specification.

What is claimed is:

1. A linkage assembly mountable on a console for operating a control arm link, the control arm link positionable between at least a first position for a relatively low operating setting and a second position for a relatively high operating setting;

the linkage assembly comprising:

bell crank means movable at least between a third and fourth position for positioning said control arm link in various operating positions between at least said first and said second positions;

a first actuator including a manually operable portion and an extensible link portion, said first actuator associated with said control arm link by said bell crank means and operably movable to responsively position said bell crank means between at least said third and said fourth positions;

a second actuator including a compressible link and a pedal portion, said second actuator spatially removed from said first actuator and associated with said control arm link by said bell crank means and releasably operative to position said bell crank means so that said control arm link is moved at most from a relatively high operating setting to a relatively low operating setting while the manually operable portion of the first actuator remains undisturbed;

said extensible link portion extendable by motion of said second actuator for resiliently returning the control arm link to a relatively high operating position upon release of said second actuator; and said compressible link for allowing said control arm link to travel in response to said first actuator beyond the relatively low operating setting while the pedal portion remains undisturbed;

said bell crank means interconnecting said extensible link and said compressible link with the control arm link.

2. The linkage assembly of claim 1 wherein the control arm link includes a third off position relatively less than the relatively low operating position, further wherein the first actuator is operably movable for positioning the control arm link at said off position.

further the linkage assembly includes first stop means for limiting motion of said first actuator, and further wherein the assembly comprises second stop means for limiting motion of the second actuator.

3. The linkage assembly of claim 2 wherein the manually operable portion of the first actuator includes:

a first lever arm rotatably positionable at a first, second, and third setting corresponding to the off, relatively low, and relatively high positions of the control arm link;

a first link;

coupling means for allowing said first link to be positioned by said first lever arm while preventing said first lever arm from being positioned by said first link;

second bell crank means for operatively connecting said first link with the extensible link portion.

4. The linkage assembly as set forth in claim 3 wherein the second actuator comprises a bracket rigidly associated with the console, said pedal portion rotatably mounted in said bracket, the compressible link associating said pedal portion with the first bell crank means.

5. The linkage assembly as set forth in claim 4 wherein the second stop means comprises a second stop member for limiting the travel of said pedal member.

6. The linkage assembly as set forth in claim 5 wherein the first stop means comprises a first stop member rigidly associated with the second bell crank and engaging the console upon positioning of the control arm link in the relatively high position by the first lever arm.

7. The linkage assembly as set forth in claim 4 wherein the second stop means further comprises an elongated arm rigidly affixed at one end to the bracket and extending outwardly therefrom, the elongated arm having adjustably mounted at the other end thereof the second stop member.

8. The linkage assembly as set forth in claim 1 wherein the extensible link portions includes an extendible linkage and third stop means for limiting extension of the extendible linkage.

9. The linkage assembly as set forth in claim 8 wherein the extendible linkage is extendible from a first short length to a second relatively longer length and includes resilient means for resiliently biasing the extendible linkage to the first short length; the second relatively longer length determined by the third stop means.

* * * * *